US005989790A

United States Patent [19]

Wernicke

[11] Patent Number: 5,989,790

[45] Date of Patent: Nov. 23, 1999

[54] PROCESS FOR THE PRODUCTION OF ARCHIVAL SILVER IMAGES

[75] Inventor: Ubbo Wernicke, Rösrath, Germany

[73] Assignee: Agfa Gevaert AG, Germany

[21] Appl. No.: 09/212,954

[22] Filed: Dec. 15, 1998

[30] Foreign Application Priority Data

Dec. 22, 1997 [DE] Germany ..... 197 57 220
Feb. 9, 1998 [DE] Germany ..... 198 05 103

[51] Int. Cl.[6] ..... G03C 5/39

[52] U.S. Cl. ..... 430/429; 430/428; 430/463

[58] Field of Search ..... 430/428, 429, 430/463

[56] References Cited

FOREIGN PATENT DOCUMENTS 401961 11/1933 United Kingdom .
1155376 6/1969 United Kingdom .

*Primary Examiner*—Hoa Van Le
*Attorney, Agent, or Firm*—Connolly Bove Lodge & Hutz

[57] ABSTRACT

Archival photographic silver images are obtained by the finishing bath's containing 10 to 60 mg of metal ions/liter of metals, the electrode potential of which in the electrochemical series is more positive than that of silver.

7 Claims, No Drawings

PROCESS FOR THE PRODUCTION OF ARCHIVAL SILVER IMAGES

This invention relates to a processing method for the production of archival photographic silver images comprising at least the stages black-&-white development, fixing, finishing treatment and drying, wherein drying follows immediately after the finishing treatment.

It is known that, on exposure to high levels of air pollution, photographic silver images on paper, black-&-white negatives and black-&-white slides become unattractive in a relatively short time due to the transformation of the black image silver into brownish silver compounds. The transformation is frequently not homogeneous, instead beginning in discrete areas of the image and spreading over the course of time.

This unwanted change of the black image silver is in particular observed in museums and hairdressing salons and in images stored under acrylic sheet. In the case of museums, formalin, which is conventionally used for preservation or originates from chipboard, is suspected of having an influence. In the case of hairdressing salons, peroxides and sulfur compounds are suspected of having an influence.

It is known to treat silver images with a solution of approx. 5 to 10 g of potassium rhodanide in 1 liter of water for approx. 1 to 3 minutes in order to improve silver stability.

It is furthermore known that silver images may be "toned" with gold salts, the objective being to change the colour of the image silver.

To this end, finished silver images are treated, generally for a few minutes, with a gold salt solution which, in addition to thiourea or thiocyanate, contains 0.1 to 1 g of gold chloride/liter. Rinsing is then repeated, any excess adhering salts are removed, and drying then performed.

The object of the invention is further to improve to the stability of silver images, wherein it should be possible to incorporate the measures necessary for this purpose into a conventional black-&-white process without additional processing stages, without requiring additional time and without changing the image tone.

A further objective was to eliminate the negative influence of formalin on the archival properties of the silver. As is known, formalin is a constituent of many finishing baths for processing photographic materials. Not only does formalin prevent the disruptive growth of algae and microorganisms in the finishing baths, it also promotes the drying properties of the photographic emulsions and largely prevents the formation of drying marks. It thus supports the action of the wetting agents.

There is thus little willingness to dispense with formalin in finishing baths. Unfortunately, this substance does not only promote the quality of the freshly developed image (negative), but it also impairs the stability and archival properties of the developed silver under unfavourable environmental conditions.

Thus, in the interest of readily achieving optimum (fresh) image quality, the use of formalin should not be dispensed with.

Attempts to achieve image stabilisation by adding conventional quantities of thiocyanate ions to conventional finishing baths consisting of wetting agents and formalin met with failure due to the unusable quality of the images, which exhibit extreme soiling due to the elevated salt content, unless rinsing was subsequently repeated.

This would, however, have resulted in lengthening of the process and all the developing machines installed worldwide would have had to be converted. Moreover, the positive effect of formalin on the drying operation would also have been cancelled out.

Attempts to incorporate known gold toning into the standard developing process also met with failure. A separate bath upstream from the finishing treatment would have lengthened the process and altered the image tone.

A combined bath prepared from 0.1 wt. % gold salt solution/wetting agent and formalin resulted in destruction of the formalin by the acidic gold salt and would again have resulted in lengthening of the conventional process.

Suitable black-&-white processing methods are black-&-white negative and black-&-white reversal processes, wherein the black-&-white negative process consists of the above stated stages and the black-&-white reversal process consists of at least the following stages: first development, bleaching, optionally clearing, second exposure, second development, fixing, finishing treatment and drying.

It has now surprisingly been found that the object of the invention may be achieved if the finishing bath contains 10 to 60 mg of metal ions/liter of metals, the electrode potential of which in the electrochemical series is more positive than that of silver. Examples are ions of gold, platinum, palladium, iridium; gold ions, in particular gold(III) ions, and palladium ions are preferred.

10 to 30 mg of gold(III) ions/liter are preferably used, in particular in the presence of wetting agents. Suitable wetting agents are e.g. those of the nonylphenol type.

Thiocyanate ions are preferably additionally used in the development bath immediately upstream from the fixing bath and/or in the fixing bath and/or in the finishing bath in a total quantity of 50 to 500 mg/l, in particular of 100 to 400 mg/l.

The photographic material used is preferably a black-&-white reversal film based on AgBr emulsions, which may contain up to 10 mol. % of AgCl and up to 10 mol. % of AgI, and having a transparent support. The emulsions in particular contain 2 to 10 mol. % of AgI.

A suitable thiocyanate compound is, for example, potassium thiocyanate; a suitable gold compound is, for example, $AuCl_3$.

Formaldehyde may furthermore be added to the finishing bath in a quantity of up to 1 g/l.

EXAMPLES 1 to 15

A conventional commercial black-&-white reversal film, for example Scala 200 from Agfa-Gevaert AG, was exposed with a grey step wedge and processed in the following baths and dried.

| | |
|---|---|
| First development | 20 ° C./6 min |
| 1st rinsing | 20 ° C./2 min |
| Bleaching bath | 20 ° C./2 min |
| 2nd rinsing | 20 ° C./2 min |
| Clearing bath | 20 ° C./4 min |
| 3rd rinsing (with second exposure) | 20 ° C./2 min |
| Second developer | 20 ° C./4 min |
| 4th rinsing | 20 ° C./2 min |
| Fixing bath | 20 ° C./4 min |
| 5th rinsing | 20 ° C./4 min |
| Finishing bath | 20 ° C./2 min |

Example 1 (Comparison)

Finishing bath consisting of 2 ml of formalin, 25 wt. %

5 ml of nonylphenol, 10 wt. %

993 ml of deionised water.

Example 2 (Comparison)

Finishing bath as Example 1, but without nonylphenol.

Example 3 (Comparison)

Finishing bath as Example 1, but without formalin.

Example 4 (Comparison)

Finishing bath as Example 1, but without formalin and without nonylphenol.

Example 5 (Comparison)

Finishing bath as in Example 1 with the addition of 5 g of potassium thiocyanate/liter.

Example 6 (Comparison)

Finishing bath as in Example 1 with the addition of 1 g of $AuCl_3$/liter.

Example 7

Finishing treatment as follows.

| | |
|---|---|
| 2 min | fixing bath |
| 2 min | rinsing |
| 4 min | treatment with 5 g of potassium thiocyanate/l |
| 2 min | rinsing |
| 2 min | finishing bath (as Example 1). |

Example 8

As Example 7, but replacing the potassium thiocyanate with 1 g of $AuCl_3$/liter.

Example 9 (according to the invention)

As Example 1, but with the addition of 25 mg of $AuCl_3$/liter to the finishing bath.

Example 10 (according to the invention)

As Example 1, but with the addition of 250 mg of potassium thiocyanate/liter to the fixing bath and 25 mg of $AuCl_3$/liter to the finishing bath.

Example 11 (according to the invention)

As Example 1, but with the addition of 250 mg of potassium thiocyanate/liter to the second developer and 25 mg of $AuCl_3$/liter to the finishing bath.

Example 12 (according to the invention)

As Example 1, but with the addition of 250 mg of potassium thiocyanate/liter and 25 mg of $AuCl_3$/l to the finishing bath.

Example 13 (according to the invention)

As Example 1, but with the addition of 250 mg of potassium thiocyanate/liter to both the second developer and the fixing bath and 25 mg of $AuCl_3$/liter to the finishing bath.

The film samples treated in accordance with Examples 1 to 13 were placed in an atmosphere with an increased $H_2O_2$ content. Temperature 50° C. The time until the image specimens began to turn brown was determined. Brown colouration is a clear indication of damage to the image silver. The test was terminated after 30 days.

| Example | Time | Comments |
|---|---|---|
| 1 | 3 days | |
| 2 | 3 days | |
| 3 | 5 days | mould growth in bath |
| 4 | 5 days | mould growth in bath |
| 5 | 8 days | unusable when fresh due to salt residues |
| 6 | 16 days | bath unusable after 24 h due to precipitates |
| 7 | 17 days | not usable in practice due to process change |
| 8 | 16 days | c.f. Example 7 |
| 9 | 17 days | |
| 10 | 22 days | |
| 11 | 20 days | |
| 12 | 30 days | no change |
| 13 | 30 days | no change |

Comparison of Examples 1 and 2 with 3 and 4 demonstrates that, while omitting formalin does indeed improve image stability, the baths very rapidly undergo spoilage.

Addition of rhodanide alone (Example 5) also brings about an improvement, which is, however, still inadequate.

Not until small quantities of gold(III) are added according to Example 9 is the desired improvement achieved, which is further promoted by the addition of thiocyanate (Examples 10 to 13) without there being any need to dispense with formalin.

I claim:

1. Process for the production of archival photographic silver images by processing an exposed silver halide material comprising at least the stages black-&-white development, fixing, finishing treatment and drying, wherein drying follows immediately after the finishing treatment, characterised in that the finishing bath contains 10 to 60 mg of metal ions/liter of metals, the electrode potential of which in the electrochemical series is more positive than that of silver.

2. Process according to claim 1, characterised in that thiocyanate ions are preferably additionally present in the development bath immediately upstream from the fixing bath and/or in the fixing bath and/or in the finishing bath in a total quantity of 50 to 500 mg/l.

3. Process according to claim 1, characterised in that the processing method is a black-&-white reversal process.

4. Process according to claim 1, characterised in that the silver halide emulsions of the photographic emulsions are AgBr emulsions containing up to 10 mol. % of AgCl and up to 10 mol. % of AgI.

5. Process according to claim 1, characterised in that the metal ions are gold(III) ions and/or palladium ions.

6. Process according to claim 1, characterised in that the quantity of gold(III) ions and/or palladium ions is 10 to 30 mg/l.

7. Process according to claim 5, characterised in that the finishing bath contains a wetting agent.

* * * * *